US006561073B1

(12) United States Patent
Høgmoe

(10) Patent No.: US 6,561,073 B1
(45) Date of Patent: May 13, 2003

(54) DEVICE AND METHOD FOR CARRYING, LOADING AND COCKING A FIREARM

(76) Inventor: Jørgen Høgmoe, Gyldenløvesgate 29, N-0260 Oslo (NO)

( * ) Notice: Subject to any disclaimer, the term of this patent is extended or adjusted under 35 U.S.C. 154(b) by 0 days.

(21) Appl. No.: 09/982,606

(22) Filed: Oct. 18, 2001

(51) Int. Cl.[7] ..... F41C 33/08
(52) U.S. Cl. ..... 89/1.42; 89/1.4
(58) Field of Search ..... 42/73; 89/1.42, 89/1.4

(56) References Cited

U.S. PATENT DOCUMENTS

| | | | | | |
|---|---|---|---|---|---|
| 2,383,471 | A | * | 8/1945 | Colby | 89/1.42 |
| 3,774,498 | A | * | 11/1973 | Moller et al. | 42/71 |
| 4,967,502 | A | * | 11/1990 | Vernon | 42/70.08 |
| 5,085,433 | A | * | 2/1992 | Parsons | 42/1.16 |
| 5,345,706 | A | * | 9/1994 | Brown | 42/94 |
| 5,896,850 | A | * | 4/1999 | Sullivan, Jr. | 89/1.42 |
| 5,956,879 | A | * | 9/1999 | Zerega | 42/72 |

FOREIGN PATENT DOCUMENTS

| | | | | |
|---|---|---|---|---|
| FR | 888.965 | * | 12/1943 | 89/1.42 |
| GB | 100028 | * | 1/1917 | 89/1.4 |

* cited by examiner

*Primary Examiner*—Stephen M. Johnson
(74) *Attorney, Agent, or Firm*—Rodman & Rodman

(57) ABSTRACT

A device and method for carrying, loading and cocking a firearm 40, such as a pistol or similar. A first element 10; 110 is attached to the firearm. A second element 20 is slidably disposed and displaceable within and away from the first element. A spring element 30; 130 is generally disposed in relation to the first and second elements such that the second element is fixed within said first element until a predetermined force is applied to either element. The invented device and method allows a firearm such as a pistol to be drawn, loaded and cocked in one continous movement, using only one hand.

16 Claims, 3 Drawing Sheets

DEVICE AND METHOD FOR CARRYING, LOADING AND COCKING A FIREARM

BACKGROUND OF THE INVENTION

1. Field of the Invention

This invention relates to the field of firearms. More specifically, the invention relates to a device and method for carrying, loading and cocking a firearm such as a pistol.

2. Description of the Related Art

Hand held firearms such as pistols and revolvers are normally contained in and carried by a holster. The holster may be fastened to a belt or strap arrangement on the user's body (waist, chest, ankle, etc.) or it may be attached to e.g. an interior part of a car. In order for the user to fire the weapon, he or she must first remove the firearm from its holster, load and cock the weapon before pulling the trigger.

3. Problem to be Solved by the Invention

Hand held firearms are often carried by individuals such as law enforcement officers, who need to rely on having the weapon readily and quickly available for use in an emergency situation. The elapsed time between the user making a decision to actually use the weapon and when the weapon is ready to be fired, is highly critical: A revolver may be cocked by pulling back the hammer while the revolver is still in its holster. It may thus be ready to be fired when it is drawn from its holster. This is, however, not the case with a weapon such as a pistol.

A weapon such as a pistol is normally loaded and cocked by pulling back the slide assembly far enough to compress hew recoil spring assembly and to allow a cartridge to be pushed into the barrel from the magazine. This operation requires two hands. generally one for holding the pistol and the other for pulling back the slide assembly. Furthermore, this loading and cocking operation cannot easily be performed while the pistol is in its holster. The operation introduces an unnecessary and—in some cases—crucial time element.

It is therefore a long felt need for a device that allows a simpler and safer, and—above all—quicker way of loading and cocking of a firearm such as a pistol.

4. Means for Solving the Problem

The present invention solves that need, in that it provides an arrangement whereby a firearm such as a pistol is loaded and cocked when it is removed from its carrying device. The device in accordance with the invention comprises in its most elementary embodiment two elements, where one is sliadably disposable within the other and where the two elements are held together by a fixture such as a spring element.

BRIEF SUMMARY OF CERTAIN INVENTIVE ASPECTS

These and other objects and features of the invention are provided by a device for carrying, loading and cocking a firearm, comprising a first element generally attached to said firearm; a second element slidably disposed and displaceable within and away from said first element; and a spring element generally disposed in relation to said first and second elements such that said second element is fixedly retainable within said first element; wherein said spring element is designed to retain said second element within said first element until a predetermined force is applied to either one of said elements.

DETAILED DESCRIPTION OF CERTAIN EMBODIMENTS OF THE INVENTION

Figure 1:
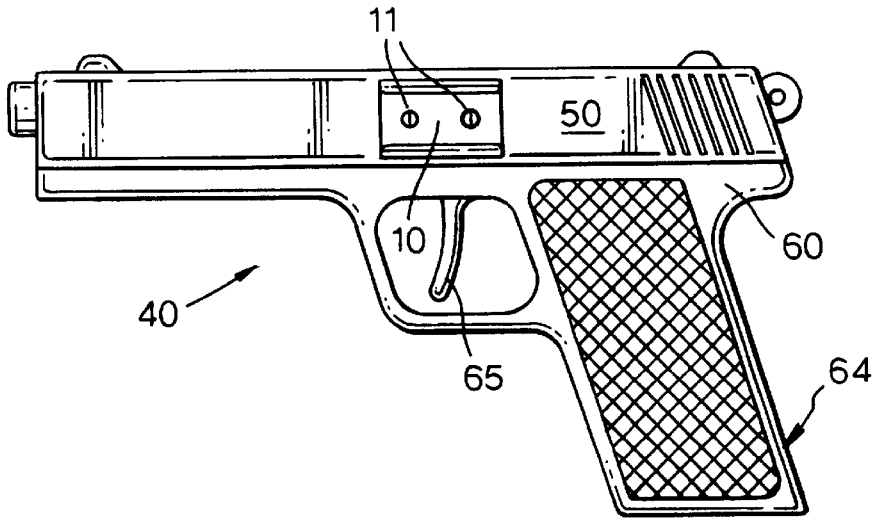
FIG. 1 is a side view of a pistol, showing a first element according to an embodiment of the present invention, attached to the pistol slide assembly.
Figure 2:
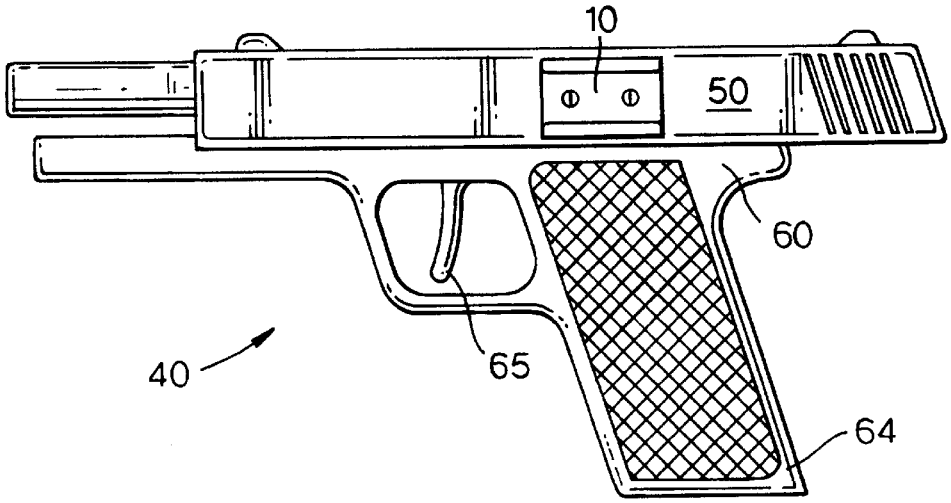
FIG. 2 is a view similar to that of FIG. 1, but shows the pistol slide assembly pulled back with respect to the pistol frame assembly.

For the purposes of the following description and referring to FIGS. 1 and 2, a pistol 40 is generally divided into two main parts: The frame assembly 60 and the slide assembly 50. A magazine assembly (not shown) is a part of the fire assembly, normally integrated in the pistol's handle 64. The pistol 40 is both loaded and cocked when the slide assembly 50 and frame assembly 60 move relative to each other (in the assemblies' generally longitudinal direction), enabling a cartridge (not shown) from the magazine to enter the barrel (not shown), until the pistol's recoil spring assembly is compressed to its predetermined state and internal stops (not shown) prevents further relative movement. This operation is normally performed by holding the frame assembly 60 relatively stationary with the one hand (gripping the handle and subsequently operating the trigger 65), while the slide assembly 50 is pulled back with the other hand until further movement between the two assemblies is prevented by pistol internal stops, at which time the other hand releases the slide assembly 50, allowing it to be driven bask to its initial position by means of an internal spring arrangement (not shown). The pistol 40 is now ready to fire.

An embodiment of the device according to the present invention comprises in general a first element or bracket 10 attached to a pistol 40 slide assembly 50. The bracket 10 may be attached by means of screws 11 or by any other means known in the art, or may be integrally formed with the pistol slide assembly. The precise location of bracket 10 on the slide assembly 50 depends inter alia on the firearm weight and center of gravity.

A second element or bracket 20 is slidably disposed within the first bracket 10. In the illustrated embodiment (as shown in e.g. FIG. 3), the second element 20 comprises a lower surface 22 and an upper surface 23 which generally are arranged in a slidable engagement with a first element lower surface 12 and upper surface 13, respectively.

Figure 3:
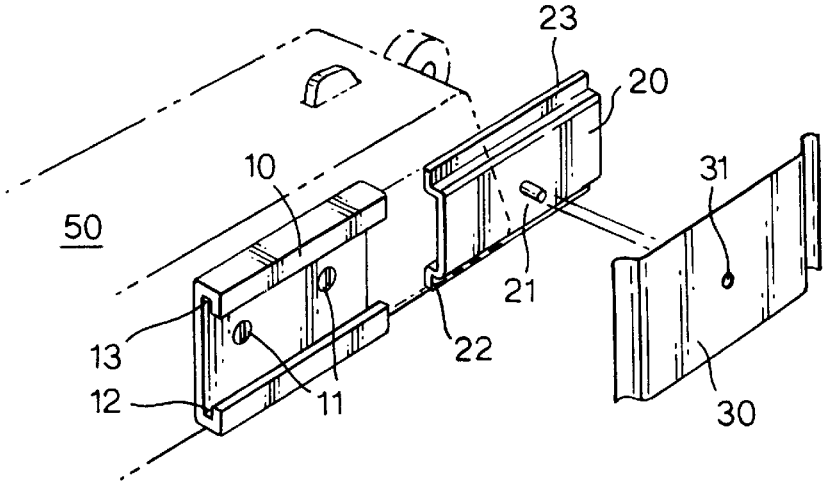
FIG. 3 is a perspective drawing of the device according to an embodiment of the present invention, in an exploded view. The figure also indicates the attachment to the pistol slide assembly (shown partly).
Figure 4:
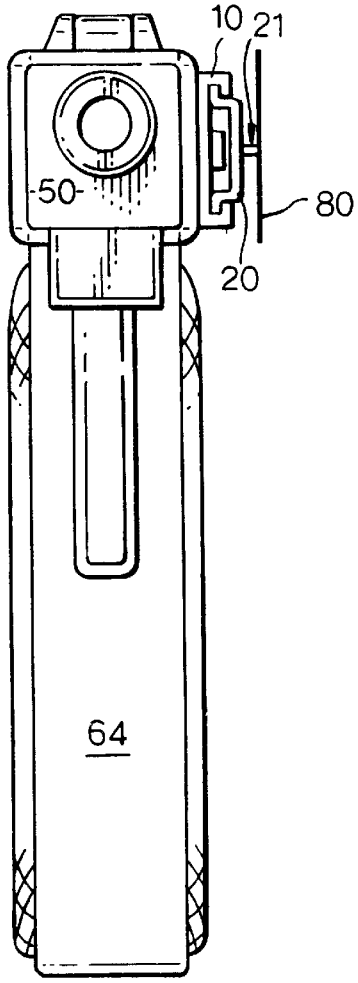
FIG. 4 is a front view of the pistol of FIG. 1, and shows the first and second elements in an assembled configuration (without the spring element for the sake of clarity of illustration) and attached to e.g. a belt.
Figure 6A:
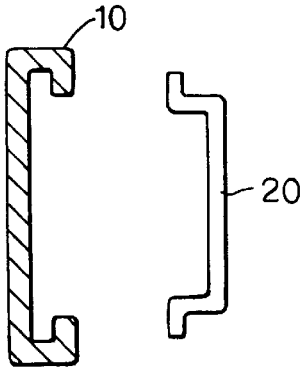
FIGS. 6A and 6B are cross-sectional views of the first and second elements, in disassembled and assembled states, respectively.
Figure 6B:
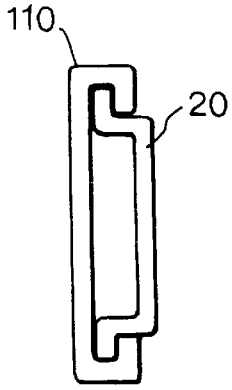
Figure 5:
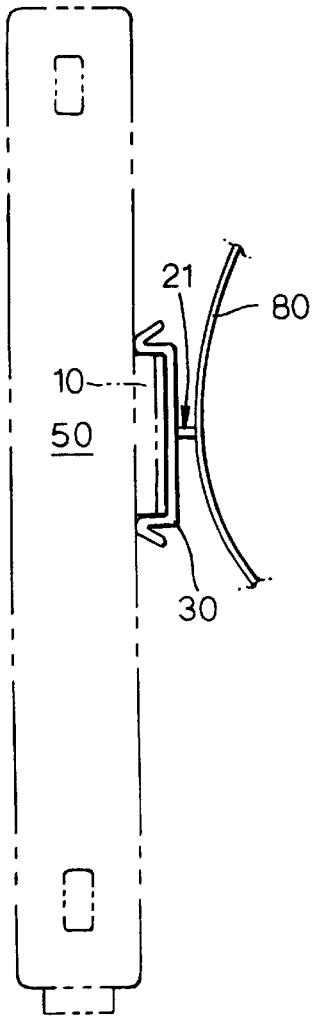
FIG. 5 is a top view of an embodiment of the device in accordance with the invention.

A spring 30—in the embodiment shown in FIGS. 3 and 5, a plate spring shaped to match the second bracket—keeps the two brackets 10, 20 together. The second bracket 20 is fixed to e.g. a user's belt 80 by means of e.g. an attachment pin 21. The illustrated embodiment shows the device as being pivotally mounted to the belt, but any other means for fixing the device to the user may be employed.

When the firearm 40 is in the carrying mode, the device in accordance with the invention serves the purpose of holding the gun, much in the same fashion as with a conventional holster.

When the firearm user wishes to draw the pistol 40, he or she grasps the pistol handle 64 in the conventional manner and proceeds to push the pistol away from him/herself and/or in a generally downward motion. The attachment assembly 21, 80 restrains the bracket 10, 20 and spring 30 assembly, and hence also any significant movement of the slide assembly 50. When the user thus continues to push on the pistol handle 64, the only part that is able to move any significant distance, is the frame assembly 60. The frame assembly thus moves, while the slide assembly is kept virtually stationary.

When the above mentioned pistol internal stops restrains any further relative motion between the frame- and slide assemblies, the continued pushing action by the user will overcome the retention force generated by the spring element 30, and the first 10 and second 20 elements will commence to slide relative to each other for a brief moment before they separate (snap apart) more or less instantaneously. The entire pistol 40, and its associated first element 10, is now released. The second element 20 remains fixed to its attachment 21, 80. The pistol is now loaded, cocked and ready to fire.

The device in accordance with the invention thus enables the user to release, load and cock his pistol in one continuous movement, using only one hand.

Figure 7A:
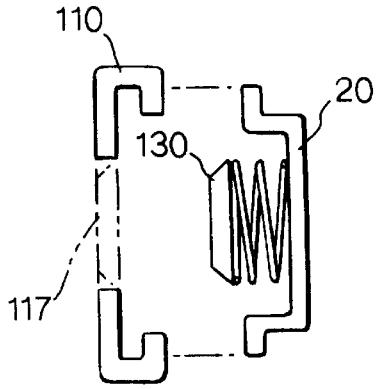
FIGS. 7A and 7B are cross-sectional views of an alternative embodiment of the invention, showing the first and second elements in disassembled and assembled states, respectively, and also showing an alternative spring element.
Figure 7B:
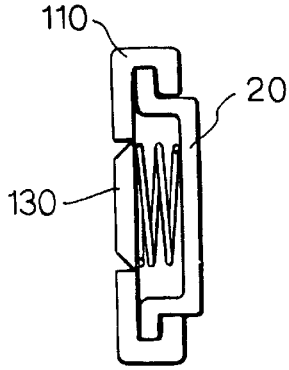

Other element-and-spring arrangements are of course possible, yielding the same effect. While the above embodiment describes the second element fitting within the first element, the reciprocal arrangement will also work. Likewise, while a plate spring has been disclosed here, other spring arrangements are conceivable for the person skilled in the art. One embodiment is illustrated in FIGS. 7A and 7B, where the spring is a coil spring 130 interacting with a hole or recess 117 in the first element 110.

The essential feature is, however, that the spring element is generally disposed in relation to a first and a second element such that the second element is fixedly retainable within the first element (or vice versa). Irrespective of its design, the spring element must be designed to retain a second element within a first element (or vice versa) until a predetermined force is applied to either one of the elements. This predetermined force must be greater than or equal to a force required to load and cock the firearm. In other words, the spring element is designed to retain a second element within a first element until the firearm slide assembly reaches a rear stop in the firearm.

Although the device according to the invention is disclosed in relation to a pistol, a person skilled in the art will appreciate that the invention is equally applicable for any type of firearm that is similarly loaded and cocked.

Although the device is disclosed with separate (e.g.) belt attachment means, the device in accordance with the invention work equally well in combination with other attachement configurations. The device in accordance with the invention may be fastened to a belt or strap arrangement on the user's body (waist, chest, ankle, etc.) or it may be attached to e.g. a vehicle or other platform.

Although the device is described above as having the first element fastened to the slide assembly by screws or other suitable means, the device according to the invention also encompasses a configuration where this element is an integral part of the slide assembly.

The foregoing description and the embodiments of the present invention are to be construed as mere illustrations of the application of the principles of the invention. The foregoing is not intended to limit the scope of the claims, but the true spirit and scope of present invention is defined by the claims.

What is claimed is:

1. Method for loading and cocking a firearm, comprising a frame assembly and a slide assembly and being associated with a first element generally attached to said firearm: a second element slidably disposed and displaceable within and away from said first element; and a spring element generally disposed in relation to said first and second elements such that said second element is fixedly retainable within said first element, and where said spring element is designed to retain said second element within said first element until a predetermined force is applied to either one of said elements; said method comprising the displacement of said frame assembly while said first and second elements and said spring element essentially restrains the slide assembly in a stationary position.

2. The method in accordance with claim 1, wherein said predetermined force is greater than or equal to force required to load and cock said firearm.

3. The method in accordance with claim 1, wherein said first element is an integral part of said firearm.

4. The method in accordance with claim 1, wherein said second element is attached to a belt.

5. The method in accordance with claim 1, wherein said second element is attached to a support surface in a vehicle.

6. The method in accordance with claim 1, wherein said spring element is designed to retain said second element within said first element until the firearm slide assembly reaches a rear stop on said firearm frame.

7. The method in accordance with claim 1 wherein said second element is attached to a strap that is securable to said support.

8. In a firearm having a frame and slide assembly, wherein said frame and slide assembly are moveable relative to each other, a device for virtually simultaneously loading, cocking and releasing the firearm, said device comprising:

a first element attached to the slide assembly of said firearm;

a second element attachable to a support other than said firearm;

said first and second elements being slidably engageable and disengageable upon relative movement between said firearm and said second element when said second element is attached to the support;

a spring member provided on one of said first and second elements to impose a force between the first and second elements that restrains slidable movement of said first and second elements relative to each other until a predetermined sliding force is applied to either of said first and second elements to enable said first and second elements to be disengaged such that said firearm is separated from said second element, whereby separation of said firearm from said second element when said second element is attached to said support causes said firearm to be loaded, cocked and released.

9. The device in accordance with claim 8, wherein said predetermined force is greater than or equal to a force required to load and cock said firearm.

10. The device in accordance with claim 8, wherein said first element is an integral part of said firearm.

11. The device in accordance with claim 8, wherein said second element is attached to a belt.

12. The device in accordance with claim 8, wherein said second element is attached to a support surface in a vehicle.

13. The device in accordance with claim 8, wherein said firearm is a pistol.

14. The device in accordance with claim 8, wherein said firearm is a pump action shotgun or rifle.

15. A device in accordance with claim 8 wherein said frame and slide assembly have a predetermined stop position that prevents rearward movement of said slide assembly relative to said frame beyond the stop position after said firearm device has been loaded and cocked, said force imposed by said spring member between said first and second elements being sufficient to restrain slidable movement of said first and second elements relative to each other until said slide assembly is moved to said stop position.

16. The device in accordance with claim 8 wherein said second element is attached to a strap that is securable to said support.

* * * * *